US011527353B2

(12) United States Patent
Deng et al.

(10) Patent No.: US 11,527,353 B2
(45) Date of Patent: Dec. 13, 2022

(54) BRACKET DEVICE FOR BEARING INDUCTOR, INDUCTOR DEVICE, AND UNINTERRUPTIBLE POWER SUPPLY

(71) Applicant: Eaton Intelligent Power Limited, Dublin (IE)

(72) Inventors: Zhonglou Deng, Shenzhen (CN); Pingchang Lin, Shenzhen (CN)

(73) Assignee: Eaton Intelligent Power Limited, Dublin (IE)

( * ) Notice: Subject to any disclaimer, the term of this patent is extended or adjusted under 35 U.S.C. 154(b) by 602 days.

(21) Appl. No.: 16/655,882

(22) Filed: Oct. 17, 2019

(65) Prior Publication Data

US 2020/0176178 A1 Jun. 4, 2020

(30) Foreign Application Priority Data

Oct. 19, 2018 (CN) ..... 201811220499.1

(51) Int. Cl.

| | |
|---|---|
| ***H01F 27/06*** | (2006.01) |
| ***H01F 27/30*** | (2006.01) |
| ***H01F 17/06*** | (2006.01) |
| ***H01F 27/26*** | (2006.01) |
| ***H01F 27/28*** | (2006.01) |
| ***H01F 30/16*** | (2006.01) |

(52) U.S. Cl.

CPC ..... *H01F 27/306* (2013.01); *H01F 17/06* (2013.01); *H01F 27/06* (2013.01); *H01F 27/266* (2013.01); *H01F 27/2895* (2013.01); *H01F 30/16* (2013.01)

(58) Field of Classification Search

CPC ..... H01F 27/306; H01F 17/06; H01F 27/06; H01F 27/266; H01F 27/2895; H01F 30/16; H01F 37/00; H01F 17/062

See application file for complete search history.

(56) References Cited

U.S. PATENT DOCUMENTS 4,176,296 A * 11/1979 Anderson ..... H01F 27/266 315/71

6,583,706 B2 * 6/2003 Larikka ..... H01F 27/266 336/229

FOREIGN PATENT DOCUMENTS

CN 105719813 A * 6/2016

* cited by examiner

*Primary Examiner* — Tuyen T Nguyen

(74) *Attorney, Agent, or Firm* — Stanek Lemon Crouse & Meeks, P.A.

(57) ABSTRACT

The present invention relates to a bracket device for bearing an inductor, an inductor device, and an uninterruptible power supply. The inductor comprises a toroidal magnetic core; and a coil comprising a plurality of wires wound around the toroidal magnetic core. The bracket device comprises: a bracket having a bearing portion adapted to bear the inductor; an insulating pad adapted to be sandwiched between the inductor and the bearing portion of the bracket, the insulating pad having an integrally formed positioning structure capable of being embedded between two adjacent wires of the coil and keeping the toroidal magnetic core fixed; and a fastener adapted to wrap around the toroidal magnetic core and press the toroidal magnetic core together with the insulating pad against the bracket. The bracket device of the present invention is capable of effectively fixing an inductor and allowing it to dissipate heat well.

14 Claims, 6 Drawing Sheets

BRACKET DEVICE FOR BEARING INDUCTOR, INDUCTOR DEVICE, AND UNINTERRUPTIBLE POWER SUPPLY

CROSS-REFERENCE TO RELATED APPLICATIONS

The present application claims priority to Chinese Patent Application No. 201811220499.1; filed Oct. 19, 2018, entitled BRACKET DEVICE FOR BERING INDUCTOR, INDUCTOR DEVICE, AND UNINTERRUPTIBLE POWER SUPPLY, the disclosure of which, is incorporated herein by reference in its entirety.

TECHNICAL FIELD

The present invention relates to the technical field of electrical equipment, and in particular, to a bracket device for bearing an inductor, an inductor device, and an uninterruptible power supply.

BACKGROUND

An uninterruptible power supply is a device for providing uninterrupted power supply to power electronic equipment. As the output power of uninterruptible power supplies increases, the volume and weight of electronic components used therein also increase accordingly. Take an inductor used in uninterruptible power supplies as an example. In an uninterruptible power supply with an output power of 275 kW, the mass of a single inductor reaches about 10 kg.

Currently, a high-power uninterruptible power supply generally employs a vertical winding toroidal inductor to improve the conversion rate of electric energy in the inductor. The vertical winding toroidal inductor comprises a toroidal magnetic core and a vertical winding coil consisting of a plurality of copper bars (or copper strips) wound around the magnetic core. In order to mount the inductor and avoid grounding of electrical connections in the vertical winding toroidal inductor in the uninterruptible power supply, a bracket device needs to be provided to fix the inductor and insulate it from ground. There exist a variety of such bracket devices in the prior art, such as an insulative base on which an inductor is placed and fixed to the insulative base by means of a steel strip that is tightly wound around the outer circumference of an inductor coil. A portion of the steel strip in contact with the coil requires provision of an insulating layer to isolate the steel strip from the coil. In order to limit the movement of the inductor along its axial direction, it is also possible to bundle the steel strip with the copper bars using additional fasteners. There also exists a bracket device in which a plurality of independent positioning blocks inserted between two adjacent coils and clamping a magnetic core are added for the purpose of limiting the movement of an inductor along its axial direction; each positioning block has an opening through which a steel strip passes.

There are three main problems with the aforementioned bracket devices. Firstly, an insulating layer closely attached to the outer circumference of a coil affects heat dissipation of an inductor. Secondly, more parts are required or the parts are more scattered, hindering assembly. Thirdly, copper bars in the coil are arranged such that the spacing between two adjacent copper bars at the inner circumference of the coil that is relatively closest to the center of a magnetic core is the smallest, or two adjacent copper bars may even be in contact at the inner circumference of the coil; at the same time, the spacing between the two adjacent copper bars at the outer circumference of the coil that is relatively far from the center of the magnetic core is the largest. As a result of these problems, once a copper bar is stressed at a position especially near the outer circumference of the coil, swaying or even tilting easily occurs. Considering that a steel strip does not completely limit swaying of a positioning block, such swaying could easily have adverse effects on a copper bar around the positioning block. In particular, since the spacings between all copper bars in practical applications cannot be equal along the circumference of the inductor as designed, when the shape of the positioning block cannot be adapted to the unequal spacings between the copper bars, the positioning block abuts and presses on at least one of two adjacent copper bars and causes it to sway, or forces the adjacent copper bar to tilt away from a designed position, consequently damaging the stability of the inductor. This tilted copper bar may even have adverse effects on other copper bars in the vicinity. This situation is especially true when the copper bars are thinner.

Therefore, there exists a desire in the industry for a bracket device that is simple in structure and that can effectively fix an inductor while allowing the inductor to effectively dissipate heat.

SUMMARY

The present invention is intended to provide a bracket device for bearing an inductor that can solve the above problems.

The present invention is also intended to provide an inductor device to which the foregoing bracket device is applied.

The present invention is also intended to provide an uninterruptible power supply to which the foregoing inductor device is applied.

In order to achieve the above objectives, according to an aspect of the present invention, a bracket device for bearing an inductor is provided, wherein the inductor comprises: a toroidal magnetic core; and a coil comprising a plurality of wires wound around the toroidal magnetic core, wherein the bracket device comprises: a bracket having a bearing portion adapted to bear the inductor; an insulating pad adapted to be sandwiched between the inductor and the bearing portion of the bracket, the insulating pad having an integrally formed positioning structure capable of being embedded between two adjacent wires of the coil and keeping the toroidal magnetic core fixed; and a fastener adapted to wrap around the toroidal magnetic core and press the toroidal magnetic core together with the insulating pad against the bracket.

The inductor is fixedly borne on the bracket, and the insulating pad isolates the bracket from the inductor to ensure that the inductor is not grounded. The positioning structure is integrally formed on the insulating pad, and is not movable in the insulating pad. The insulating pad is tightly sandwiched between the bracket and the inductor by the fastener, and its positioning structure is inserted between the two adjacent wires of the coil and bears and positions the magnetic core of the inductor so as to hold the inductor in place. The stable positioning structure matches with the fastener to ensure that the magnetic core is firmly borne, restricting its axial, radial, and circumferential movements, thereby achieving effective fixing of the inductor, and regardless of whether the movement of the fastener is slight or fierce, the positioning structure is not in direct contact/engagement with the fastener, so that the positioning structure will not be affected. Moreover, the insulating pad can also function to reduce vibration and noise. In addition, the insulating pad integrally formed with the positioning structure effectively reduces the number of parts and components of the bracket device, allowing the structure of the bracket device to be simplified and compact, and saving materials and reducing costs. Moreover, the fastener bound to the magnetic core do not have any impact on heat dissipation of the coil.

In a specific implementation, the positioning structure has two opposing clamping projections extending in a direction away from the bracket, and a recess, formed between the two clamping projections, adapted to receive the toroidal magnetic core. The two clamping projections are capable of clamping two opposite end faces of the toroidal magnetic core to hold the toroidal magnetic core in place and to limit axial and circumferential movements of the toroidal magnetic core.

In a specific implementation, the insulating pad comprises: a base adapted to abut against the bearing portion of the bracket; and a shim extending from the base in a direction away from the bracket, the positioning structure being formed at a free end of the shim away from the bracket.

In a specific implementation, the insulating pad comprises a plurality of shims spaced apart, wherein each shim is adapted to be inserted between two adjacent wires of the coil, and when the inductor is borne on the bracket device, the free end of each of the plurality of shims points to the central axis of the toroidal magnetic core. In this way, the insertion of the shims between the wires in conformity with gaps between the wires is faciliated.

In a specific implementation, the insulating pad has an opening through which the fastener passes. In this way, the fastener moving relative to the insulating pad or separating from the insulating pad can be prevented.

In a specific implementation, the bearing portion of the bracket has an arcuate bearing surface, the curvature of the arc being adapted to the outer circumference of the coil, and the bracket having an opening through which the fastener passes. In this way the effective area of the bracket bearing the inductor can be increased, thereby providing the inductor with improved stable bearing, and the fastener passing through the opening can prevent the fastener from moving relative to the bracket or separating from the bracket.

In a specific implementation, the bracket further comprises a mounting portion connected to the bearing portion, and the mounting portion comprises a hook and/or a mounting hole.

In a specific implementation, all or at least a portion of the fastener in contact with the inductor is insulative.

According to another aspect of the present invention, a bracket device for bearing an inductor is provided, the inductor comprising: a toroidal magnetic core; and a coil comprising a plurality of wires wound around the toroidal magnetic core, wherein the bracket device comprises: a bracket having an insulating bearing portion and an insulating positioning structure integrally formed on the bearing portion, the positioning structure being capable of being embedded between two adjacent wires of the coil and keeping the toroidal magnetic core fixed; and a fastener adapted to wrap around the toroidal magnetic core and press the toroidal magnetic core against the bracket.

In addition to being able to bear the inductor, the insulating bearing portion of the bracket also ensures that the inductor is not grounded. The positioning structure is integrally formed on the insulating bearing portion, and is not movable in the insulating bearing portion. The inductor is pressed against the insulating bearing portion by the fastener, and the positioning structure is inserted between two adjacent wires of the coil and bears and positions the magnetic core of the inductor so as to hold the inductor in place. The stable positioning structure matches with the fastener to ensure that the magnetic core is firmly borne, restricting its axial, radial, and circumferential movements, thereby achieving effective fixing of the inductor, and the positioning structure is not in direct contact/engagement with the fastener, so regardless of whether the movement of the fastener is slight or fierce, the positioning structure will not be affected. Moreover, the insulating bearing portion can also function to reduce vibration and noise. In addition, the insulating bearing portion integrally formed with the positioning structure effectively reduces the number of parts and components of the bracket device, allowing the structure of the bracket device to be simplified and compact, and saving materials and reducing costs. Moreover, the fastener bound to the magnetic core do not have any impact on heat dissipation of the coil.

According to still another aspect of the present invention, an inductor device is provided, comprising: an inductor having a toroidal magnetic core and a coil consisting of a plurality of wires wound around the toroidal magnetic core; and a bracket device for bearing the inductor, wherein the bracket device is the bracket device described above.

According to still another aspect of the present invention, an uninterruptible power supply is provided, comprising an inductor device, wherein the inductor device is the inductor device described above.

Part of other features and advantages of the present invention will be obvious after those skilled in the art read the present application, and the rest are described in the following specific implementations with reference to the accompanying drawings.

BRIEF DESCRIPTION OF THE DRAWINGS

Embodiments of the present invention are described in detail in the following with reference to the accompanying drawings, wherein.

DESCRIPTION OF THE REFERENCE NUMERALS

Figure 1:
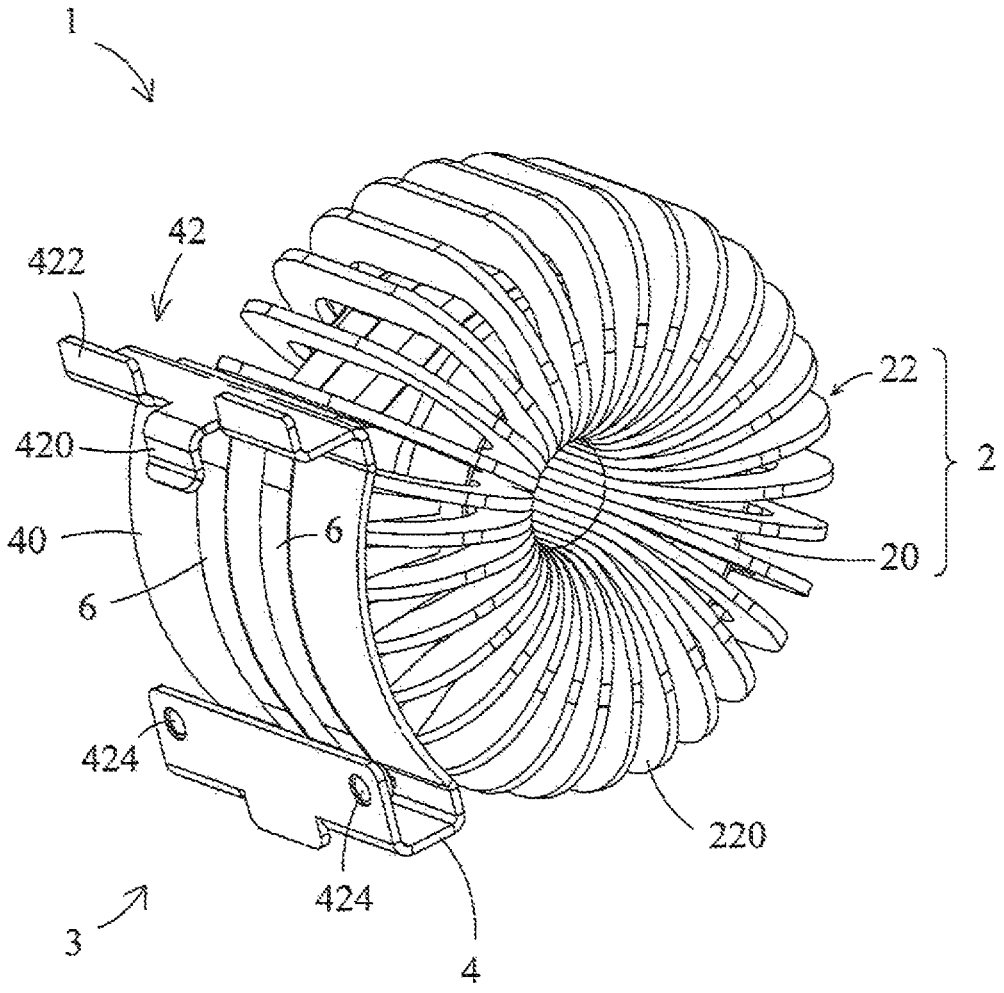
FIG. 1 is a schematic perspective view of an inductor device according to an embodiment of the present invention.

1. Inductor Device
2. Inductor
20. Toroidal Magnetic Core
22. Coil
220. Wire
3. Bracket Device
4. Bracket
40. Bearing Portion
42. Mounting Portion
420. Hook

422. Limiting Member
424. Mounting Hole
44. Opening
46. Opening
5. Insulating Pad
50. Base
52. Shim
522. Clamping Projection
524. Recess
54. Opening
56. Opening
6. Fastener
7. Mounting Base

DETAILED DESCRIPTION

A schematic scheme of the disclosed device is described in detail with reference to the accompanying drawings. Although providing the accompanying drawings is to present some implementations of the present invention, the accompanying drawings do not need to be drawn according to the size of particular embodiments, and certain features can be enlarged, removed, or locally exploded to better illustrate and explain the disclosure of the present invention. Part of members in the accompanying drawings can be positionally adjusted according to actual requirements without affecting the technical effect. In the description, the term "in the accompanying drawings" or similar terms do not necessary refer to all of the accompanying drawings or examples.

Some directional terms used in the following to describe the accompanying drawings, such as "in," "out," "upper," and "lower," and other directional terms are construed as having normal meanings thereof and refer to those directions involved when the accompanying drawings are viewed normally. Unless otherwise specified, the directional terms in the description are substantially in accord with conventional directions understood by those skilled in the art.

The terms "first," "first one," "second," and "second one" and similar terms used in the present invention do not indicate any sequence, number, or importance in the present invention, and are used only to distinguish one component from other components.

The term "integral molding" as used in the present invention relates to a part comprising two or more portions/components, wherein the part is either integrally formed and the portions/components are not divided during processing of the part, or the portions/components are separately processed and then combined together by appropriate securing and connection means (such as bonding, melting, mechanical connection such as snapping, screwing, tight fitting, etc.) such that the portions/components cannot move in the finally formed part. Both of the above two methods are encompassed by the "integral molding" described in the present invention.

FIG. 1 to FIG. 4 schematically show an embodiment of an inductor device of the present invention. The inductor device is applicable to an uninterruptible power supply. In the shown embodiment, the inductor device 1 includes an inductor 2 and a bracket device 3 bearing the inductor 2. The inductor 2 includes a toroidal magnetic core 20 and a coil 22 wound around the toroidal magnetic core 20. The coil 22 consists of a plurality of copper wires 220 each wound around the magnetic core 20.

Figure 4:
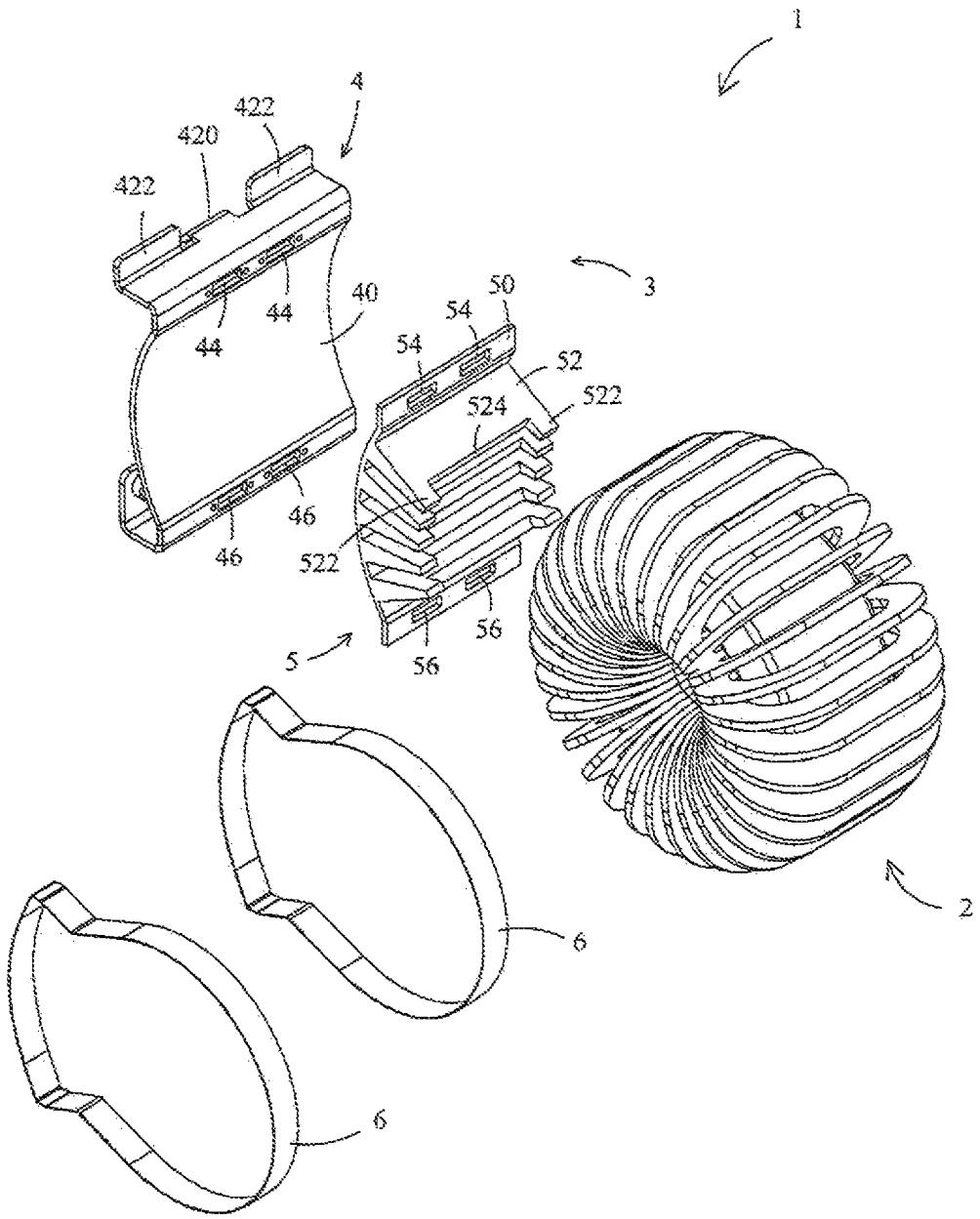
FIG. 4 is a schematic exploded view of an inductor device according to an embodiment of the present invention.

The bracket device 3 includes a bracket 4, an insulating pad 5 sandwiched between the bracket 4 and the inductor 2, and a fastener 6 that fastens the bracket 4, the insulating pad 5, and the inductor 2 together. As shown in FIG. 4, the bracket 4 may be, for example, a one-piece metal member made of a metal plate (for example, an aluminum plate) having a uniform thickness, so that the bracket 4 has sufficient mechanical strength to avoid deformation when bearing the inductor 2. The bracket 4 includes a bearing portion 40 for bearing the inductor 2 and a mounting portion 42 that is connected to the bearing portion 40 and used for mounting the bracket 4 on a mounting base (indicated by numeral "7" in FIG. 5). The bearing portion 40 is a curved plate, the curvature thereof being adapted to the outer circumference of the coil 22 of the inductor 2, thereby providing the inductor 2 with improved stable bearing. In an embodiment not shown, it is also possible to construct only a bearing surface of the bearing portion 40 facing the inductor 2 as a curved surface adapted to the outer circumference curvature of the coil 22 of the inductor 2; further, the surface of the bearing portion 40 opposing the inductor 2 can be planar or of other configurations.

Figure 5:
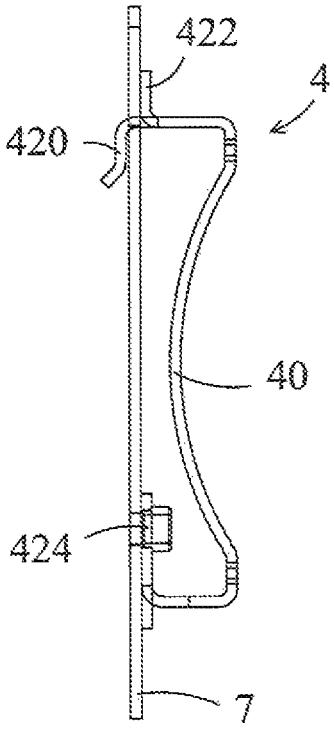
FIG. 5 is a schematic planar view of a bracket suspended from a mounting base according to an embodiment of the present invention.

As shown in FIG. 1 and FIG. 4, the mounting portion 42 includes a hook 420 and a mounting hole 424 in the shown embodiment, wherein the hook 420 is formed by integral bending at one end of the bearing portion 40 (at the upper end of the bearing portion 40 with the suspended bracket 4 as shown in FIG. 5 as a reference), whereas the mounting hole 424 is formed at the other end of the bearing portion 40 opposite to the end where the hook 420 is positioned (at the lower end of the bearing portion 40 with the suspended bracket 4 as shown in FIG. 5 as a reference). With reference to FIG. 5, the bracket 4 is suspended from the mounting base 7 by means of the hook 420 and secured in place by means of a bolt passing through the mounting hole 424. The mounting base 7 may be, for example, a vertical wall of a cabinet of an uninterruptible power supply.

It is conceivable that either of the hook 420 and the mounting hole 424 is used, or other positioning portions are used in place of the hook 420 and the mounting hole 424. For example, a positioning hole is opened in the mounting base 7, and a positioning member for inserting/snapping in the positioning hole is formed on the bracket. Alternatively, an adhesive is applied between the bracket and the mounting base 7 as a positioning portion.

In order to further limit movement of the bracket 4 relative to the mounting base 7, a limiting member 422 may be formed on each of two opposite sides of the hook 420, and the limiting member 422 is formed by, for example, bending a part of the metal plate in a direction opposite to the bending direction of the hook 420. As shown in FIG. 5, after the bracket 4 is suspended from the mounting base 7, the mounting base 7 is positioned between the hook 420 and the limiting member 422. Specifically, a side of the hook 420 facing the mounting base 7 rests on a first surface of the mounting base 7 or is only slightly spaced from the first surface, whereas a side of the limiting member 422 facing the mounting base 7 rests on a second surface of the mounting base 7 opposite to the first surface or is only slightly spaced from the second surface.

It should be noted that the division of the bracket into the bearing portion and the mounting portion herein is only considered for the purpose of distinguishing between functions and for ease of description; this technical solution does not suggest that a physical boundary/structure that can clearly identify their respective regions is necessarily present on the bracket, regardless of whether the bracket is integrally formed or assembled from a plurality of components/portions.

Figure 2:
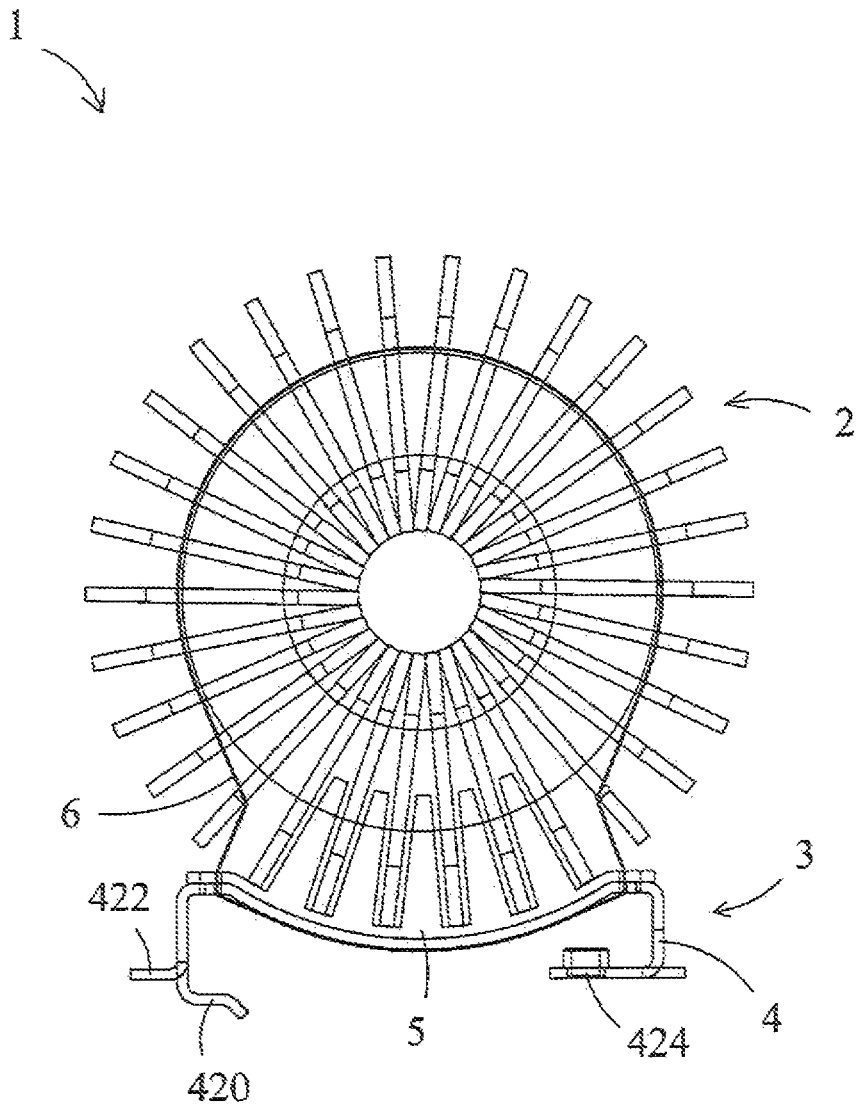
FIG. 2 is a schematic planar view of an inductor device according to an embodiment of the present invention.
Figure 3:
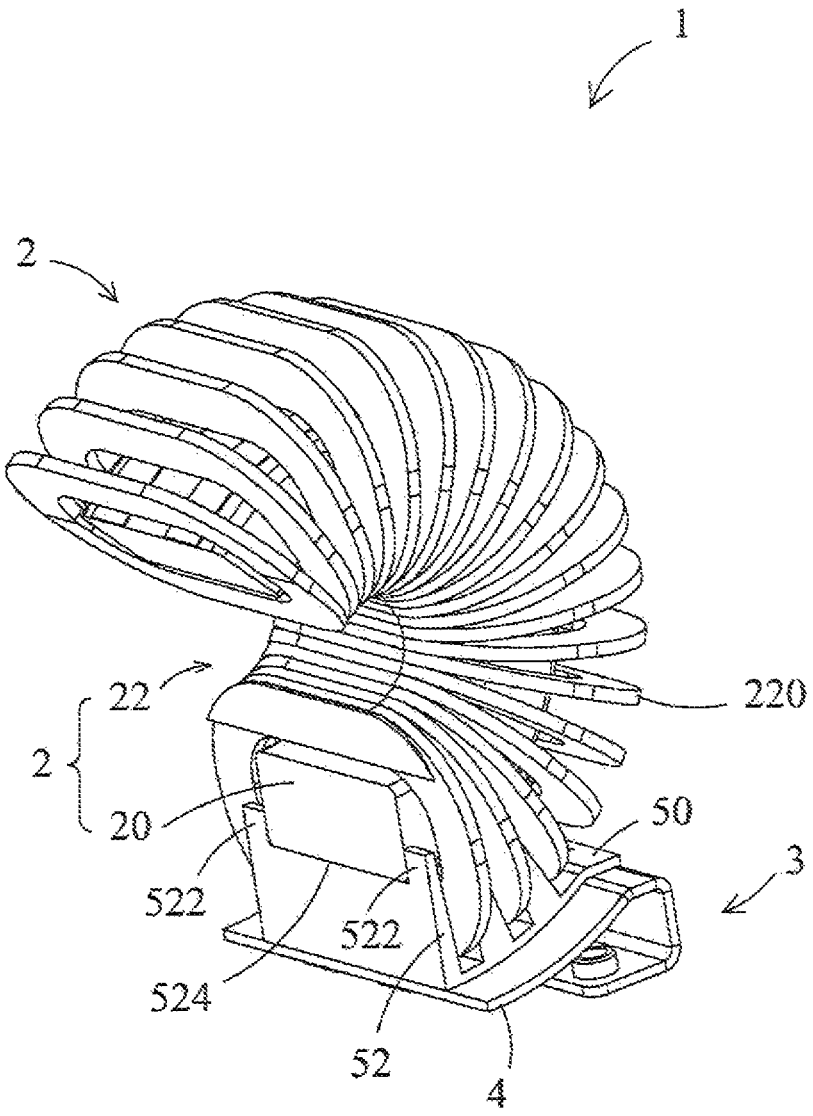
FIG. 3 is a perspective sectional view of an inductor device according to an embodiment of the present invention.

The structure of the insulating pad 5 can be better understood by referring to FIG. 2 to FIG. 4. The insulating pad 5 is made of an insulating material and is preferably made of a tough or flexible insulating material such as rubber, plastic, silicone, and etc. that is capable of completely isolating the bracket 4 from the inductor 2. In the shown embodiment, the insulating pad 5 includes a substantially sheet-shaped base 50 and five shims 52 extending from the base 50 in a direction away from the bracket 4. In other embodiments, the number of shims 52 can be increased or decreased according to requirements, such as the number of wires in the coil or the diameter of the coil. The shims 52 of the insulating pad 5 are integrally formed with the base 50, for example, the insulating pad 5 is formed by an integral molding process, or the shims 52 are secured to the base 50 by means of bonding, melting, welding, or mechanical connection, etc., so that no relative movement can be generated between the shims 52 and the base 50. Each shim 52 can be inserted between two adjacent wires 220 of the coil 22 and bears and holds the toroidal magnetic core 20 to prevent axial and circumferential movements thereof, and the cushion can provide a vibration and noise reduction effect.

As shown in the figure, in an assembled state, free ends of the shims 52 away from the base 50 substantially point to the central axis of the toroidal magnetic core 20 so that the shims 52 can be inserted between the wires 220 more smoothly. In this state, the insulating pad 5, as a whole and as viewed from its axial projection, conforms to the curvature of the bearing portion 40 of the bracket 4 and the outer circumference curvature of the toroidal magnetic core 20, thereby better conforming to the bearing portion 40 and providing the toroidal magnetic core 20 with improved stable bearing. The shims 52 may be wedge-shaped with a cross-sectional area tapered in a direction away from the base 50 to better accommodate gaps between two adjacent wires 220 of the coil 22.

The insulating pad 5 bears and holds the toroidal magnetic core 20 by means of a positioning structure formed at the free ends of the shims 52. In the shown embodiment, the positioning structure includes two opposing clamping projections 522 that extend away from the bracket 4 and a recess 524 formed between the two clamping projections 522. In the assembled state, a portion of the toroidal magnetic core 20 is received in the recess 524, and since the insulating pad 5 uses a flexible material, the two clamping projections 522 can be clamped on opposite end faces of the toroidal magnetic core 20. The outer peripheral surface of the toroidal magnetic core 20 is preferably capable of abutting against the bottom surface of the recess 524. In addition, an adhesive may further be applied between the surfaces of the clamping projections and/or the surfaces of the recess and the toroidal magnetic core 20 to further secure the toroidal magnetic core 20 and the insulating pad 5 together. Alternatively or optionally, an adhesive may be applied between the insulating pad 5 and the wires 220 to secure the two together.

Alternatively, the bracket and the insulating pad may be integrated together. For example, the bracket is entirely made of an insulating material; or the bearing portion of the bracket for bearing the inductor is made of an insulating material; and the insulating shims are integrally formed on the bearing portion and a positioning structure is provided at their free ends. For example, the bracket comprising the insulating shims is formed by an integral molding process, or the insulating shims are secured to the bearing portion of the bracket by means of bonding, melting, welding, or mechanical connection, so that no relative movement can be generated between the insulating shims and the bearing portion of the bracket. For other structures of the bracket, such as the curvature of the bearing portion and the mounting portion, reference may be made to the metal bracket described above; as for other structures of the insulating shims, such as the positioning structure, reference may be made to the shims in the insulating pad described above.

Compared with the prior art, the present invention fixes the inductor by securing the magnetic core, instead of fixing an inductor by means of a coil. The size of the positioning structure can be appropriately reduced in accordance with a gap size between two adjacent wires, so that a gap is formed between the positioning structure and the two wires around, so as to avoid impact on the coil.

Figure 6:
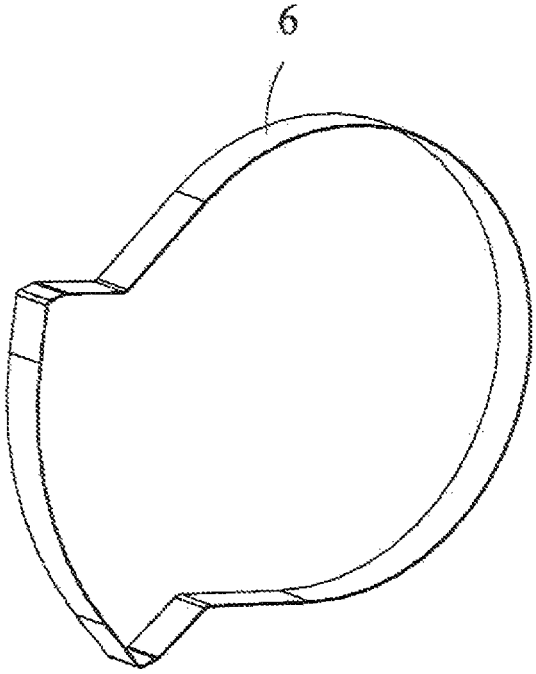
FIG. 6 is a schematic perspective view of a fastener according to an embodiment of the present invention.

As shown in FIG. 6, the fastener 6 is a closed ring that is wound around the toroidal magnetic core 20; the bracket 4 in an assembled state to press the toroidal magnetic core 20 together with the insulating pad 5 against the bracket 4. Alternatively, the fastener may be adjustable in length. For example, the fastener is of an elongated shape having two ends, both ends being provided with engaging snaps that are movable in the length direction of the fastener. Alternatively, the fastener 6 may be wound around only the toroidal magnetic core 20 and secured to a connection structure of the bracket 4.

The fastener 6 may be made, for example, of stainless steel to provide sufficient structural strength, and may be coated with an insulating layer at a position where the fastener 6 is in contact with or is possibly in contact with the toroidal magnetic core 20 and the coil 22. Alternatively, the fastener 6 may also be directly made of an insulating material that is preferably less elastic.

Two fasteners 6 are shown in the figure, but those skilled in the art will understand that the number of fasteners 6 can be correspondingly increased or decreased depending on actual needs, such as the volume, weight, etc. of the inductor.

In the shown embodiment, an opening 44 is provided at one end of the bracket 4 and an opening 46 is provided at the other end, while an opening 54 is provided at one end of the base 50 of the insulating pad 5 and an opening 56 is provided at the other end. In the assembled state, the fastener 6 is wound around the outer circumference of the toroidal magnetic core 20 and passes through the openings 44 and 46 of the bracket 4 and the openings 54 and 56 of the insulating pad 5, thereby tightening the inductor 2 to the bracket device 3. Alternatively, the openings on the bracket and the insulating pad may be replaced with recesses. Alternatively, the openings of the bracket 4 may be omitted, or the openings of the insulating pad 5 may be omitted, or both the openings of the bracket 4 and the insulating pad 5 may be omitted.

It should be understood that although the description is presented according to each embodiment, each embodiment does not necessarily include only one independent technical solution. The presentation manner of the description is merely for clearness, and those skilled in the art should regard the description as a whole, and the technical solutions in the embodiments can also be appropriately combined to form other implementations comprehensible by those skilled in the art.

What is described above is merely exemplary specific implementations of the present invention, but is not intended to limit the scope of the present invention. Any equivalent change, modification, or combination made by those skilled in the art without departing from the conception and principle of the present invention shall fall within the protection scope of the present invention.

The invention claimed is:

1. A device for bearing an inductor that includes a toroidal magnetic core and a coil that includes a plurality of wires wound around the toroidal magnetic core, the device comprises:

a bracket having a bearing portion to bear the inductor;

an insulating pad located between the inductor and the bearing portion of the bracket, the insulating pad having an integrated positioning structure configured to extend between two adjacent wires of the coil to contact the toroidal magnetic core; and a fastener configured to wrap around the toroidal magnetic core to couple the toroidal magnetic core and the insulating pad to the bracket.

2. The device according to claim 1, wherein the integrated positioning structure has two opposing clamping projections extending in a direction away from the bracket, and a recess, formed between the two clamping projections, configured to receive the toroidal magnetic core.

3. The device according to claim 1, wherein the insulating pad comprises:

a base configured to abut against the bearing portion of the bracket; and a shim extending from the base in a direction away from the bracket, the integrated positioning structure being formed at a free end of the shim away from the bracket.

4. The device according to claim 3, wherein the insulating pad comprises a plurality of shims spaced apart, wherein each shim is configured to be inserted between the two adjacent wires of the coil, and when the inductor is borne on the device, the free end of each of the plurality of shims points to a central axis of the toroidal magnetic core.

5. The device according to claim 1, wherein the insulating pad has an opening through which the fastener passes.

6. The device according to claim 1, wherein the bearing portion of the bracket has an arcuate bearing surface, a curvature of the arc being configured to an outer circumference of the coil, and the bracket having an opening through which the fastener passes.

7. The device according to claim 1, wherein the bracket further comprises a mounting portion connected to the bearing portion, and the mounting portion comprises a hook and/or a mounting hole.

8. The device according to claim 1, wherein all or at least a portion of the fastener in contact with the inductor is insulative.

9. A inductor device comprising:

a toroidal magnetic core; and a coil comprising a plurality of wires wound around the toroidal magnetic core, wherein the device comprises:

a bracket having an insulating bearing portion and an insulating positioning structure integrally formed on the bearing portion, the positioning structure configured to extend between two adjacent wires of the coil to contact the toroidal magnetic core; and a fastener configured to wrap around the toroidal magnetic core to couple the toroidal magnetic core to the bracket.

10. An inductor device, comprising:

an inductor having a toroidal magnetic core and a coil including a plurality of wires wound around the toroidal magnetic core; and a bracket device for bearing the inductor, wherein the bracket device comprises the device according to claim 1.

11. An uninterruptible power supply, comprising an inductor device, wherein the inductor device is the inductor device according to claim 10.

12. A bracket comprising:

a bearing portion having a curvature that is configured to receive an inductor with a toroidal magnetic core having about the same curvature as the bearing portion, and the toroidal magnetic core is wound by a coil comprising a plurality of turns of a wire;

an insulating pad located between the inductor and the bearing portion of the bracket, the insulating pad including a curved surface; and a plurality of positioning structures spaced apart along the curved surface of the insulating pad and radially extending from the curved surface of the insulating pad toward a center of the inductor to pass between respective adjacent ones of the plurality of turns of the wire of the coil to contact the toroidal magnetic core.

13. The bracket of claim 12 a fastener configured to wrap around the toroidal magnetic core and extending between at least one pair of the plurality of turns of the wire to contact the bracket.

14. The bracket of claim 12, wherein each of the positioning structures comprises a shim having a remote end with a recess that is shaped to contact three surfaces of the toroidal magnetic core.

* * * * *